US006758171B2

(12) United States Patent
Hwang

(10) Patent No.: US 6,758,171 B2
(45) Date of Patent: Jul. 6, 2004

(54) ENGINE COOLING SYSTEM WITH TWO THERMOSTATS

(75) Inventor: Gyu Han Hwang, Kyungki-do (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/279,095

(22) Filed: Oct. 23, 2002

(65) Prior Publication Data

US 2003/0079699 A1 May 1, 2003

(30) Foreign Application Priority Data

Oct. 26, 2001 (KR) ..... 2001-66323

(51) Int. Cl.[7] ..... F01P 7/02

(52) U.S. Cl. ..... 123/41.05

(58) Field of Search ..... 123/41.05, 41.09, 123/41.12, 41.44, 41.72, 41.74, 41.82 R

(56) References Cited

U.S. PATENT DOCUMENTS 4,369,738 A * 1/1983 Hirayama ..... 123/41.1
4,381,736 A * 5/1983 Hirayama ..... 123/41.1

FOREIGN PATENT DOCUMENTS

GB 2245703 A * 1/1992 ..... F01P/3/02
JP 57146010 A * 9/1982 ..... F01P/3/20
JP 62101816 A * 5/1987 ..... F01P/7/16
JP 6-193443 12/1994

* cited by examiner

*Primary Examiner*—Tony M. Argenbright
*Assistant Examiner*—Hyder Ali
(74) *Attorney, Agent, or Firm*—Morgan Lewis & Bockius LLP

(57) ABSTRACT

The present invention relates to an engine cooling system of an automobile, and more particularly, to an engine cooling system having two thermostats which can alleviate engine friction by delaying the flow of cooling water in the cylinder block and as a result can also improve cooling and heating efficiencies in the automobile as the resistance of water passage jacket throughout the engine decreases.

12 Claims, 2 Drawing Sheets

ENGINE COOLING SYSTEM WITH TWO THERMOSTATS

FIELD OF THE INVENTION

The present invention relates to an automobile engine cooling system, and more particularly, to a cooling system having two thermostats to improve cooling efficiency.

BACKGROUND OF THE INVENTION

An automobile engine in general is equipped with a cooling system, which is designed to radiate the heat produced as a result of burning in the combustion chamber. Engine cooling systems are commonly classified into three different types: an air cooling type wherein cylinder is cooled by exposing to the air, a water cooling type wherein cylinder is cooled by circulating water around the cylinder block, and a mixed type wherein cylinder is cooled by using both types.

In conventional water-type engine cooling systems, most of the cooling water is supplied to the cylinder block at the time of the initial engine start-up and thus raises a number of problems. First, the cylinder rapidly cools down beyond the desired level, which leads to deformation of the bore of the cylinder. In particular, the bore of the first cylinder becomes easily deformed because cooling water introduced from the outside first flows into the first cylinder of the cylinder block. Another problem is that the deformation of the cylinder bore increases the friction between the bore and the piston and as a result quickly increases the temperature of oil and the internal surface of the cylinder block thereby deteriorating fuel consumption. Also, the cooling water is supplied to the cylinder head via the cylinder block, and thus a vast amount of cooling water is required due to an increase in resistance against cooling water throughout the water passage of the engine.

SUMMARY OF THE INVENTION

The present invention provides an engine cooling system that includes two thermostats to delay the flow of cooling water in the cylinder block. Cooling water is supplied to the cylinder block and the cylinder head through two separate lines, respectively. Further, when cooling water rises beyond a predetermined temperature, cooling water confined in the cylinder block becomes mixed with cooling water that is in a process of circulation around the cylinder head without circulating through the radiator, and then guided to circulate through the radiator.

In preferred embodiments of the invention, cooling water is supplied into the cylinder head and cylinder block by a water pump and the circulation of the cooling water is selectively directed to the water pump or a radiator. The cooling water is respectively supplied into a cylinder head and cylinder block via two separate lines and the system is equipped with two thermostats. A main thermostat is disposed in the outlet line of the cylinder head. An auxiliary thermostat is disposed in the outlet line of the cylinder block and connected to the outlet line of the cylinder head. The main thermostat operates at a lower temperature than that of auxiliary thermostat and the auxiliary thermostat supplies a part of the cooling water to the outlet line of the cylinder block in a closed state.

In a preferred embodiment of the present invention, the cooling water supplied through inlet lines of the cylinder head and cylinder block accounts for about 55% and about 45% of the total cooling water, respectively. Preferably, the main thermostat connects the water passage to the water pump at a temperature below about 82° C. while connects it to the radiator at a temperature above about 82° C. The auxiliary thermostat is preferably closed at a temperature below about 95° C. but is open at a temperature above about 95° C. While closed, the auxiliary thermostat enables flow of about 5% of the cooling water in the cylinder block to the main thermostat.

The main thermostat and the auxiliary thermostat are both disposed within the water passage for cooling water circulated inside the cylinder block and cylinder head as well as within the assembly of the water passage jacket that connects the cooling water to the radiator. The overall length of the water jacket in the above cylinder block is preferably equivalent to about 50% to 60% of that of piston stroke. The water pump is disposed in counter location relative to the assembly of the water passage thereby allowing the cooling water to flow into the cylinder block and the cylinder head.

DETAILED DESCRIPTION OF THE INVENTION

Figure 1:
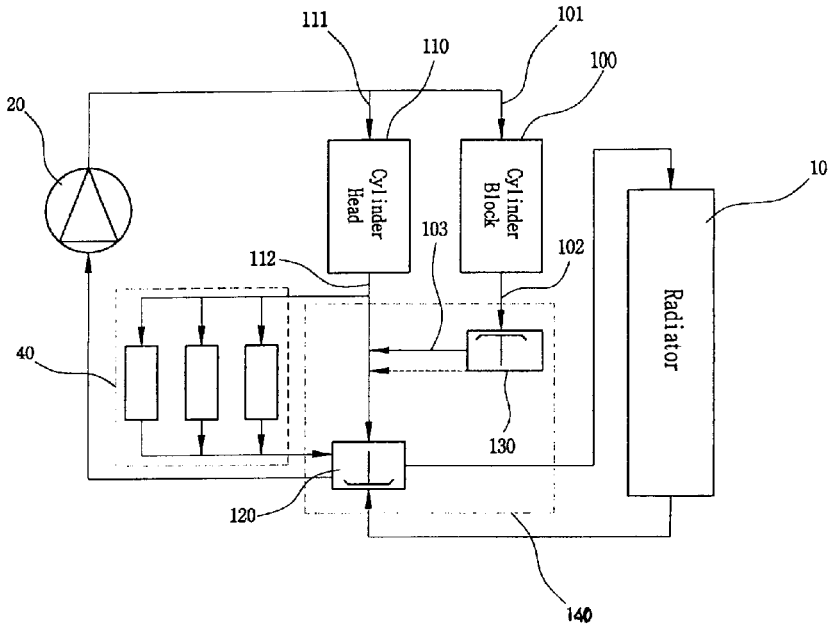
FIG. 1 is a schematic diagram of the engine cooling system according to an embodiment of the present invention.

Embodiments of the invention are explained in more detail based on the figures as set forth hereunder.

Generally, in an engine cooling system of the present invention cooling water is supplied to the cylinder block 100 as well as the cylinder head 110 at a fixed rate. In particular, the cooling water supplied to the cylinder block 100 is confined in the cylinder block 100 for a given period of time until the cooling water reaches a predetermined temperature. The cooling water thus confined in the cylinder block 100, when reaching a predetermined temperature, is mixed with cooling water released from the cylinder head 110 and then circulates. It will be appreciated by those skilled in that art that the predetermined temperature as referred to herein may be selected based on the requirement of a particular engine.

More specifically, cooling water is supplied to a cylinder block 100 by means of a water pump 20 as the engine is started. A part of the supplied cooling water is then directed to a cylinder head 110. After a cooling step in the cylinder block 100 and the cylinder head 110, the cooling water again circulates through the water pump 20 by opening/shutting of a water bypass valve 30 when a thermostat 12 disposed on the outlet of the cylinder block 100 is below a predetermined temperature. The cooling water circulates through a radiator 10 by opening/shutting of the water bypass valve 30 when the thermostat 12 is above a predetermined temperature. Further, the cooling water heated in the above cylinder block 100 is connected to a heater 40.

Cooling water is supplied from the water pump 20 to the assembly of the water passage 140 disposed on the side of the cylinder block 100. The cooling water supplied to the assembly of the water passage 140 flows to the inside of the water jacket through the cylinder block 100 and a part of the cooling water is supplied directly to the cylinder head 110 through the inlet formed in the cylinder block 100.

Preferably, about 45% of the total cooling water supplied by the water pump 20 is supplied to the cylinder block 100 while about 55% is supplied to the cylinder head 110.

The assembly of the water passage 140 serves as a housing to control the flow of the cooling water located inside of the engine and all water passages diverge from this assembly. The water passage assembly 140 is supplied with the cooling water by the connection with the water pump 20 and the pipe 141 and the cooling water supplied to the assembly 140 then flows to the cylinder block 100 and the cylinder head 110 via the water pump 20. A part of the cooling water released from the cylinder block 100 and the cylinder head 110 is then supplied to a heater 40 and circulates through a radiator 10 controlled by a thermostat, which will be described in detail later.

Figure 2:
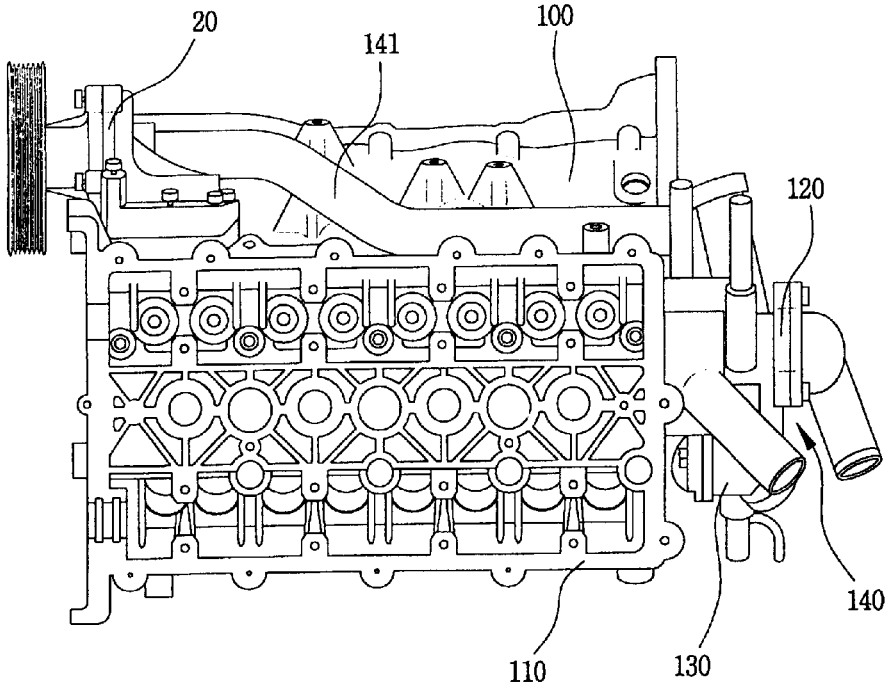
FIG. 2 is a cross-sectional view of an engine employing an embodiment of the present invention.
Figure 3:
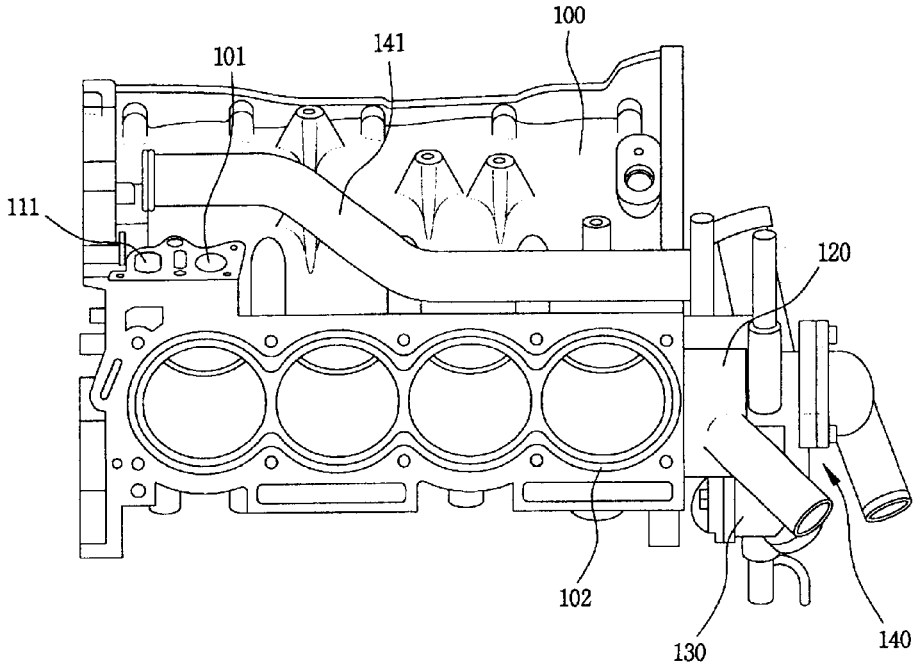
FIG. 3 is a cross-sectional view of the engine cooling system as in FIG. 2 without the cylinder head.

In an embodiment of the present invention, the water pump 20 is installed opposite to the assembly of the cylinder block 100 and the cylinder head 110 in order to let cooling water flow in a longitudinal direction for a smooth flow. In a preferred embodiment of the present invention, as shown in FIG. 2 and FIG. 3, the water pump 20 and the assembly 140 are disposed on opposite sides of the cylinder block.

The cylinder block 100 and the cylinder head 110, supplied with cooling water via separate lines as described above, have an outlet 102 for cooling water in the cylinder block 100 and an outlet 112 in the cylinder head 110, respectively. These outlets 102, 112 are connected to the assembly of the water passage 140. In particular, there is provided a main thermostat 120 in outlet 112 for cooling water in the cylinder head 110. This thermostat operates a bypass valve (not shown) to determine whether the cooling water released from the outlet 112 is supplied from the assembly back to the water pump 20 or to a radiator 40. Also, outlet 102 has a bypass tube 103 connected to the cylinder head 110 and an auxiliary thermostat 130 is provided in this bypass tube 103.

In a preferred embodiment of the present invention, the main thermostat 120 has a wax-type thermostat fixed at a lower temperature than that of the auxiliary thermostat 130. In a further preferred embodiment, the main thermostat 120 is operated at approximately 82° C. while the auxiliary thermostat 130 be operated at approximately 95° C. This is to prevent the cylinder core from cooling too rapidly by confining the cooling water supplied to the cylinder block 100 in a stagnant state until it reaches a predetermined temperature although the cooling water supplied to the cylinder head 110, affected relatively less by temperature relative to that of the cooling water supplied to the cylinder block 100, is circulated faster than that of the cylinder block 100.

Also, it is preferred that a bypass tube 103 be set up so that about 5% of total cooling water, supplied to the cylinder block 100, can be transported to the main thermostat 120 by the auxiliary thermostat 130. This is to determine the timing of opening/shutting by supplying a part of the cooling water, supplied to the cylinder block 100, to the main thermostat 120 thereby detecting the temperature of the cooling water in the above cylinder block 100 in an auxiliary thermostat 130.

In another preferred embodiment of the present invention, it is desirable that the length of the water jacket (not shown) disposed in the cylinder block 100 should be shorter than that of the conventional water jacket, preferably, about 50–60% of the piston stroke. This is made possible because the cooling water supplied to the cylinder block 100 by the water jacket is confined until this cooling water reaches a predetermined temperature, thus preventing the cylinder bore from a rapid cool-down due to circulation. Therefore, the amount of the total cooling water can be decreased because cooling water supplied to the cylinder block 100 is confined until cooling water reaches the predetermined temperature.

Subsequently, the cooling water supplied from the water pump 20 flows into the cylinder block 100 and the cylinder head 110 and then undergoes an operation as set forth hereunder.

1) At warm-up (i.e., both the main thermostat and the auxiliary thermostat are closed) forty-five percent of the cooling water supplied to the cylinder block 100 of the total cooling water is confined and thus remains stagnant, whereas the rest (55%) flows to the main thermostat 120 via the cylinder head 110. At this time, cooling water supplied to the cylinder head 110 continues to circulate through the water pump by the bypass valve because the main thermostat is closed.
2) At the beginning of drive after warm-up (i.e., the main thermostat is open while the auxiliary thermostat is closed) forty-five percent of the cooling water supplied to the cylinder block 100 is confined and thus remains stagnant, and a part of the cooling water (about 5%) flows to the above main thermostat 120. Because the main thermostat is open (i.e., the bypass valve is open), 45% of the cooling water supplied to the cylinder head 110 circulates. Of course, 5% of the cooling water supplied to the cylinder block 100, is released to the outlet 112 of the cylinder head through the bypass tube 103. It is then determined whether the auxiliary thermostat reached the predetermined temperature or not.
3) After extended operation (i.e., both the main thermostat and the auxiliary thermostat are open) forty-five percent of the cooling water confined in the cylinder block 100 is mixed with 55% cooling water released from the outlet of the cylinder head and then circulates via the assembly of the water passage 140 through the radiator 10. Therefore, cooling water becomes confined within the cylinder block until the temperature of cooling water goes above a predetermined temperature, and the cooling water in the cylinder block circulates together with cooling water in the cylinder head if the temperature goes over the setting point.

As stated above, the present invention relates to an engine cooling system which enables to supply cooling water to the cylinder block and the cylinder head, respectively. The engine cooling system is provided with two different thermostats disposed in the outlets with different predetermined temperatures and is advantageous, inter alia:

1) when an automobile is at warm-up stage, cooling water is confined in the cylinder block delaying the flow of cooling water, and the surface and the oil in the bore of the cylinder block can reach an appropriate temperature within a short time,
2) accordingly, the friction between the inside of the cylinder and the piston decreases, the fuel consumption increases, and the harm exhaust-gas decreases.
3) the deformation of the bore of the first cylinder decreases less because cooling water flows to the first cylinder and circulates.

What is claimed is:

1. An engine cooling system wherein cooling water is supplied into a cylinder head and a cylinder block by water pump and the circulation of said cooling water is selectively directed through a water pump or a radiator, said cylinder head and cylinder block each having an outlet line, the system comprising:

at least two separate lines to supply cooling water into the cylinder head and the cylinder block;

a main thermostat disposed in the outlet line of said cylinder head; and an auxiliary thermostat disposed in the outlet line of said cylinder block and connected to the outlet line of said cylinder head;

wherein said main thermostat operates at a lower temperature than that of auxiliary thermostat and said auxiliary thermostat supplies a part of said cooling water to the cylinder head outlet line in a closed state.

2. The engine cooling system according to claim 1, wherein inlet lines of said cylinder head and said cylinder block are designed to supply about 55% and about 45% of the total cooling water, respectively.

3. The engine cooling system according to claim 1, wherein said main thermostat connects the water passage to said water pump via a bypass valve at a temperature below about 82° C. while connecting said water passage to said radiator at a temperature above about 82° C.

4. The engine cooling system according to claim 1, wherein said auxiliary thermostat is not completely closed but leaves a room for partial influx of cooling water at a temperature below about 95° C. while it is completely closed at a temperature above 95° C.

5. The engine cooling system according to claim 1, wherein 5% of the total volume of cooling water in the cylinder block can be flowed into said main thermostat when said auxiliary thermostat is still closed.

6. The engine cooling system according to claim 1, wherein said main thermostat and said auxiliary thermostat are disposed within the water passage for cooling water circulated inside the cylinder block and cylinder head as well as within the assembly of said water passage jacket that connects said cooling water to said radiator.

7. The engine cooling system according to claim 1, wherein said cylinder block has the entire length of the water passage jacket is equivalent to about 50% to about 60% relative to that of piston stroke.

8. The engine cooling system according to claim 1, wherein said water pump is disposed in counter location relative to the assembly of the water passage thereby allowing the cooling water to flow into the cylinder block and the cylinder head.

9. A cooling system for an engine cylinder head and cylinder block, the cooling system comprising:

outlet lines for the cylinder head and cylinder block;

a main thermostat disposed in the cylinder head outline line for selectively directing coolant flow through a radiator and a coolant pump;

inlet lines from the coolant pump to the cylinder head and cylinder block, respectively; and an auxiliary thermostat disposed in the cylinder block outlet line for selectively directing coolant flow from the cylinder block via a bypass line to the outlet line of the cylinder head, upstream of the main thermostat.

10. The cooling system of claim 9, wherein the radiator includes inlet and outlet lines leading from and to the main thermostat, respectively.

11. The cooling system of claim 10, further comprising a heater with inlet and outlet lines, wherein the heater inlet line communicates with the cylinder head outlet line between the cylinder head and said bypass line, and the heater outlet line directs flow into the main thermostat.

12. The cooling system of claim 9, wherein the main thermostat operates at a lower temperature than the auxiliary thermostat such that the auxiliary thermostat supplies a partial flow of coolant through the bypass line to the cylinder head outlet line in a closed state.

* * * * *